US011724928B2

(12) United States Patent
Mastro et al.

(10) Patent No.: US 11,724,928 B2
(45) Date of Patent: Aug. 15, 2023

(54) BEVERAGE DISPENSING MACHINES AND BACKBLOCKS THEREOF

(71) Applicant: Marmon Foodservice Technologies, Inc., Osseo, MN (US)

(72) Inventors: Brian Mastro, Des Plaines, IL (US); Zachary Dresser, Batavia, IL (US); Chris Coul, Geneva, IL (US); E. Scott Sevcik, Crystal Lake, IL (US)

(73) Assignee: Marmon Foodservice Technologies, Inc., Osseo, MN (US)

( * ) Notice: Subject to any disclaimer, the term of this patent is extended or adjusted under 35 U.S.C. 154(b) by 0 days.

(21) Appl. No.: 17/743,007

(22) Filed: May 12, 2022

(65) Prior Publication Data

US 2022/0380192 A1 Dec. 1, 2022

Related U.S. Application Data

(60) Provisional application No. 63/193,800, filed on May 27, 2021.

(51) Int. Cl.
*B67D 1/00* (2006.01)

(52) U.S. Cl.
CPC ..... *B67D 1/0044* (2013.01); *B67D 1/0057* (2013.01); *B67D 1/0081* (2013.01); *B67D 2210/00034* (2013.01)

(58) Field of Classification Search
CPC .. B67D 1/0044; B67D 1/0057; B67D 1/0081; B67D 2210/00034; B67D 2001/0093; B67D 2001/0094; B67D 2210/00028; B67D 2210/0006; B67D 1/14; B67D 1/0021
See application file for complete search history.

(56) References Cited

U.S. PATENT DOCUMENTS 3,893,481 A * 7/1975 Watts ..... F16K 11/078 137/636.4
4,887,740 A * 12/1989 Smith ..... B67D 1/0084 251/363
4,932,564 A 6/1990 Austin et al.
(Continued)

FOREIGN PATENT DOCUMENTS

WO 2020160420 8/2020

OTHER PUBLICATIONS

European Extended Search Report for European Patent Application No. 22174245.5, dated Oct. 26, 2022.

*Primary Examiner* — Donnell A Long
(74) *Attorney, Agent, or Firm* — Andrus Intellectual Property Law, LLP

(57) ABSTRACT

A backblock includes a body with a cavity connected to an inlet and an outlet. A spindle is positioned with a first end within the cavity and a second end with a tab exterior of the body. A latching plate is configured for translative movement relative to the body. The latching plate includes a keyhole with a bore and a channel. The bore is dimensioned to receive the spindle and the channel is dimensioned to receive the tab. The latching plate has a first latch position proximate to the body and a second latch position spaced apart from the body. When the tab is in alignment with the channel, the latching plate can translate to the second latch position about the tab. When the tab is out of alignment with the channel, the tab retains the latching plate in the first latch position.

20 Claims, 14 Drawing Sheets

(56) References Cited

U.S. PATENT DOCUMENTS

| | | | | |
|---|---|---|---|---|
| 5,129,549 | A | 7/1992 | Austin | |
| 5,285,815 | A | 2/1994 | Henry et al. | |
| 5,931,348 | A | 8/1999 | Guadalupi | |
| 6,192,935 | B1 | 2/2001 | Schroeder et al. | |
| 6,196,007 | B1 | 3/2001 | Schlosser et al. | |
| 6,286,721 | B1 | 9/2001 | Pellegrini | |
| 6,328,181 | B1 | 12/2001 | Schroeder et al. | |
| 6,439,428 | B1 | 8/2002 | Schroeder et al. | |
| 6,698,229 | B2 | 3/2004 | Renken et al. | |
| 6,698,621 | B2 | 3/2004 | Landers et al. | |
| 7,156,115 | B2 | 1/2007 | Everett et al. | |
| 7,287,671 | B2 | 10/2007 | Morrow, Sr. et al. | |
| 7,641,074 | B2 | 1/2010 | Edwards et al. | |
| 7,743,946 | B2 | 6/2010 | Edwards et al. | |
| 7,793,678 | B2 | 9/2010 | Edwards et al. | |
| 8,074,842 | B2 | 12/2011 | Edwards et al. | |
| 8,365,957 | B2 | 2/2013 | Edwards et al. | |
| 9,085,451 | B2 | 7/2015 | Santy | |
| 9,683,671 | B2 | 6/2017 | Le Pellec et al. | |
| 2004/0168466 | A1 | 9/2004 | Landers et al. | |
| 2007/0051747 | A1* | 3/2007 | Landers ..... | B67D 1/08 222/129.1 |
| 2007/0056988 | A1 | 3/2007 | Edwards et al. | |
| 2009/0065529 | A1 | 3/2009 | Guadalupi | |
| 2009/0107559 | A1 | 4/2009 | Edwards et al. | |

* cited by examiner

BEVERAGE DISPENSING MACHINES AND BACKBLOCKS THEREOF

CROSS-REFERENCE TO RELATED APPLICATIONS

The present application claims priority of U.S. Provisional Patent Application No. 63/193,800, filed on May 27, 2021 and which is incorporated herein by reference in its entirety.

FIELD

The present disclosure relates to beverage dispensing machines, and more particularly relates to backblocks that facilitate dispensing of beverages via beverage dispensing valves.

BACKGROUND

Beverage dispensing machines are widely used to dispense beverages to operators in different settings (e.g., restaurants, convenience stores), and the machines can be configured to dispense a variety of beverages. In certain examples, the machines include beverage dispensing valves that are each configured to dispense a specific mixed beverage to the operator. The valve receives and dispenses one or more diluents or base fluids (e.g., still water, carbonated water) and one or more concentrates (e.g., soda syrup concentrate) that mix together and thereby form the mixed beverage. The valves are commonly removably connected to the machine via conventional backblocks through which the fluids flow to the valves from fluid sources.

Examples of known machines, valves, and/or backblocks are disclosed in following patent references, which are hereby each incorporated herein by reference in entireties.

U.S. Pat. No. 4,932,564 discloses a two-flavor post-mix carbonated beverage dispensing head with a mounting block and valve body with a treble quick disconnect for water and two syrups.

U.S. Pat. No. 5,285,815 discloses a post-mix beverage dispensing valve having a quick disconnect mounting.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

An example of a backblock for use in beverage dispensing includes a body. The body includes an inlet configured to receive a fluid, an outlet configured to dispense the fluid, and a cavity defined within the body, the cavity open to the inlet and to the outlet. A spindle is elongated in an axial dimension between a first end and a second end. The spindle is positioned with the first end within the cavity and the second end exterior of the body to permit rotation of the spindle about the axial dimension within the cavity. A tab is located at the second end of the spindle. A latching plate is configured for translative movement relative to the body. The latching plate includes a keyhole with a bore and a channel. The bore is dimensioned to receive the spindle and the channel is dimensioned to receive the tab. The latching plate has a first latch position proximate to the body and a second latch position spaced apart from the body. When the tab is in alignment with the channel, the latching plate can translate to the second latch position about the tab. When the tab is out of alignment with the channel, the tab retains the latching plate in the first latch position.

In further examples of the backblock, the spindle includes a passageway therethrough, the passageway configured to fluidly connect the inlet to the outlet. The spindle may be rotatable about the axial dimension within the cavity between a first spindle position wherein the passageway is oriented within the cavity to occlude fluid flow from the inlet to the outlet and a second spindle position wherein the passageway is in alignment with the inlet and the outlet to permit fluid flow from the inlet to the outlet. In the first spindle position, the tab is in alignment with the channel and in the second spindle position, the tab is out of alignment with the channel. The inlet may be a plain water inlet to receive plain water, and the body may further include a carbonated water inlet open to the cavity and configured to receive carbonated water. The spindle may rotate to a third spindle position within the cavity wherein the passageway is in alignment between the carbonated water inlet and the outlet to permit carbonated water to flow from the carbonated water inlet to the outlet through the passageway. In the third spindle position, the tab is out of alignment with the channel. The latching plate may include at least one engagement feature configured to releasably connect to a valve. The body may include a first side with the outlet and a second side with the plain water inlet and the carbonated water inlet. The body may include a third side and a fourth side opposite the third side. The third side and the fourth side extend orthogonally between the first side and the second side. A latching assembly may include a pair of latching plates and a rod extending between the pair of latching plates. The latching assembly translates as a unit between the first latch position and the second latch position. The body includes a bore through the body extending from the third side to the fourth side and the rod extends through the bore between the pair of latching plates. The spindle may include a first spindle stop on a portion of the spindle received within the cavity. The spindle may include a stop tab on a portion of the spindle exterior of the body. The first spindle stop and the stop tab may respectively engage portions of the body to define rotation of the spindle to the second spindle position and the third spindle position.

Another example of a backblock includes a body. The body has a first side, a second side opposite the first side, a third side, and a fourth side opposite the third side. The third side and the fourth side extend between the first side and the second side. A first inlet through the second side is configured to receive a first fluid. A second inlet through the second side is configured to receive a second fluid. A third inlet through the second side is configured to receive a third fluid. A first outlet from the first side is fluidly connected to the first inlet and a second inlet through a first cavity in the body. A second outlet from the first side is fluidly connected to the third inlet through a second cavity in the body. A first spindle is rotatably positioned within the first cavity. A second spindle is rotatably positioned within the second cavity. The first spindle and the second spindle are each elongated in an axial dimension between a first end positioned within the respective cavity and a second end extending exterior of the body. A first tab is at the second end of the first spindle. A second tab is at the second end of the second spindle. A latching assembly is configured for unitary translative movement relative to the body between a first latch position with the first latch plate spaced apart from the third side of the body and the second latch plate proximate to the fourth side of the body and a second latch position with the first latch plate proximate the third side of the body and the second latch plate spaced apart from the fourth side of the body. The latch assembly includes a first latching plate adjacent to the third side of the body and a second latching plate adjacent to the fourth side of the body. The second latching plate includes a first keyhole with a first bore and a first channel wherein the first bore is dimensioned to receive the first spindle and the first channel is dimensioned to receive the first tab. The second latching plate includes a second keyhole with a second bore and a second channel wherein the second bore is dimensioned to receive the second spindle and the second channel is dimensioned to receive the second tab. When the first tab is out of alignment with the first channel or the second tab is out of alignment with the second channel, the first tab or the second tab retain the latching assembly in the first position. When the first tab is in alignment with the first channel and the second tab is in alignment with the second channel, the latching assembly can translate between the first position and the second position.

In further examples of the backblock, the first tab extends radially away from the axial dimension of the first spindle and the second tab extends radially away from the axial dimension of the second spindle. The first spindle includes a first passageway there through. The first passageway is configured to selectively connect the first inlet or the second inlet to the first outlet. The first spindle is rotatable about the axial dimension within the first cavity between a first spindle position wherein the first passageway is oriented within the first cavity to occlude fluid flow from the first inlet or the second inlet to the first outlet, a second spindle position wherein the first passageway is in alignment with the first inlet and the first outlet to permit flow of the first fluid from the first inlet to the first outlet through the first passageway, and a third spindle position wherein the first passageway is in alignment with the second inlet and the first outlet to permit flow of the second fluid from the second inlet to the first outlet through the first passageway. In the first spindle position, the first tab is in alignment with the first channel. In the second spindle position or the third spindle position, the first tab is out of alignment with the first channel. The second spindle includes a second passageway there through and the second passageway is configured to selectively connect the third inlet to the second outlet. The second spindle is rotatable about the axial dimension within the second cavity between a fourth spindle position wherein the second passageway is oriented within the second cavity to occlude fluid flow from the third inlet to the second outlet, and a fifth spindle position wherein the second passageway is in alignment with the third inlet and the second outlet to permit flow of the third fluid from the third inlet to the second outlet through the second passageway. In the fourth spindle position, the second tab is in alignment with the second channel. In the fifth spindle position, the second tab is out of alignment with the second channel.

In still further examples, the first inlet is a plain water inlet and the first fluid is plain water, the second inlet is a carbonated water inlet and the second fluid is carbonated water, the third inlet is a syrup inlet and the third fluid is a beverage syrup. The first outlet and the second outlet are both configured for releasable connection to a valve configured to dispense one or more of the first fluid, second fluid, and the third fluid. The first latching plate and the second latching plate each include at least one engagement feature configured to releasably secure the backblock to the valve. The latch assembly is configured to secure to the valve when the latch assembly is in the second latch position and the latch assembly is configured to engage or disengage from the valve when the latch assembly is in the first latch position. The body further includes a bore through the body extending from the third side of the body to the second side of the body. The latching assembly includes a rod extending through the bore, the rod connecting the first latching plate to the second latching plate. A first sleeve is positioned within the first cavity and the first spindle rotates within the first sleeve. A second sleeve is positioned within the second cavity and the second spindle rotates within the second sleeve. A least one stud extends from the third surface in a direction away from the third surface. At least one opening through the first latching plate is configured to receive the at least one stud therein as the latching assembly translates between the first latch position and the second latch position.

An example of a beverage dispensing system includes a valve configured to receive a diluent and a syrup, and to dispense a mixed beverage comprising the diluent and the syrup through a nozzle. A frame is configured to provide structural support. A backblock of any of the examples provided above is releasably physically and fluidly connected to the valve.

Various other features, objects, and advantages will be made apparent from the following description taken together with the drawings.

DETAILED DESCRIPTION

Figure 1:
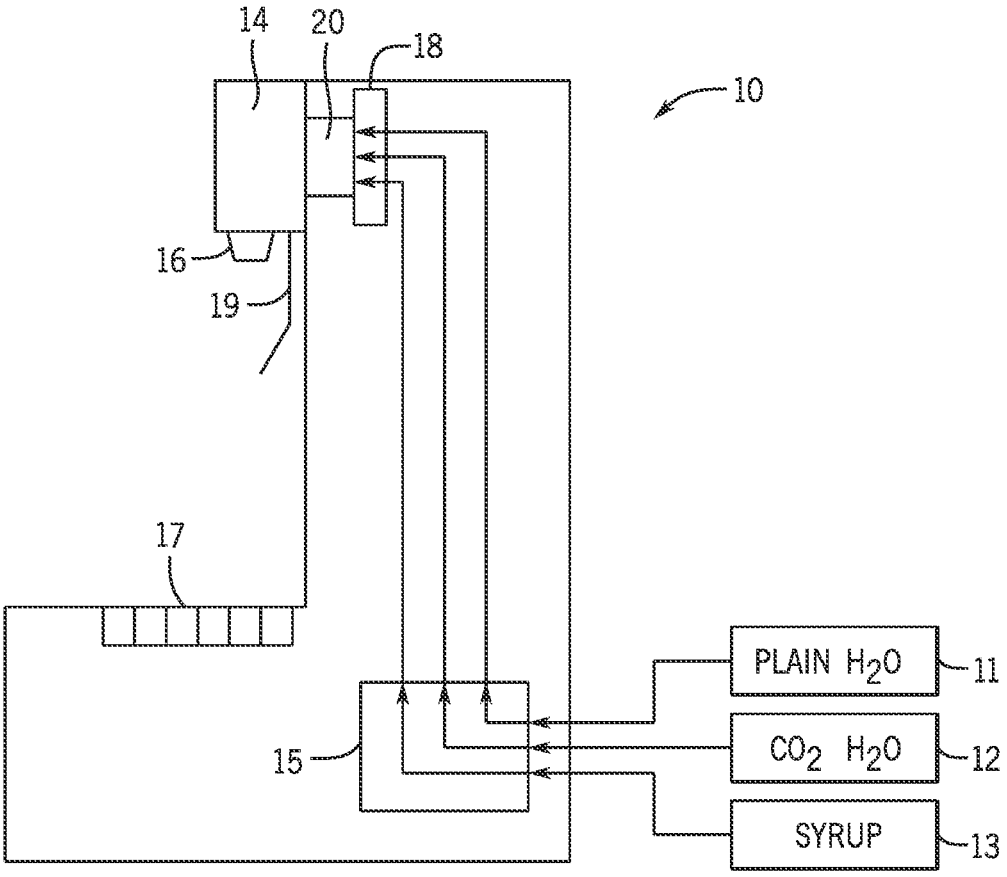
FIG. 1 depicts an example of a beverage dispenser in schematic form.

FIG. 1 depicts an example of a beverage dispenser 10 in schematic form. The dispenser includes a dispensing valve 14, which may be physically or electronically actuated by an operator. The beverage dispenser 10 includes or is otherwise connected to a plurality of fluid sources, including a plain water source 11, e.g. a facility water line, a carbonated water source 12, e.g. a carbonator provided internal to the beverage dispenser 10, and one or more concentrated beverage flavor syrup sources 13, e.g. refillable or replaceable containers of concentrate fluid.

A backblock 20 provides the fluid connection from the plain water source 11, the carbonated water source, and the syrup source 13 to the valve 14. The combination of fluids that pass through the backblock 20 determines the beverage dispensed from the valve upon actuation by the operator. The valve 14 may be actuated by operator input to a lever 19, while other forms of actuation including push buttons, touch screens, or wireless inputs are also within the present disclosure. Upon actuation of the valve 14 by the operator, the dispensing valve 14 operates to combine either plain water from the plain water source 11 or carbonated water from the carbonated water source 12 with the concentrated beverage flavor syrup from the syrup source 13 in a nozzle 16 to be dispensed as a post-mix beverage, e.g. a carbonated cola soda. A drip tray 17 below the nozzle 16 catches any overrun of the dispensed beverage.

The backblock 20 is connected to a frame 18 of the beverage dispenser 10 and the valve 14 is connected to the backblock 20. In examples, the plain water source 11, carbonated water source 12, and the one or more syrup sources 13 are fluidly connected to the backblock 20 through a cold plate 15 which cools the fluids before the fluids reach the backblock 20 and the valve 14.

Figure 2:
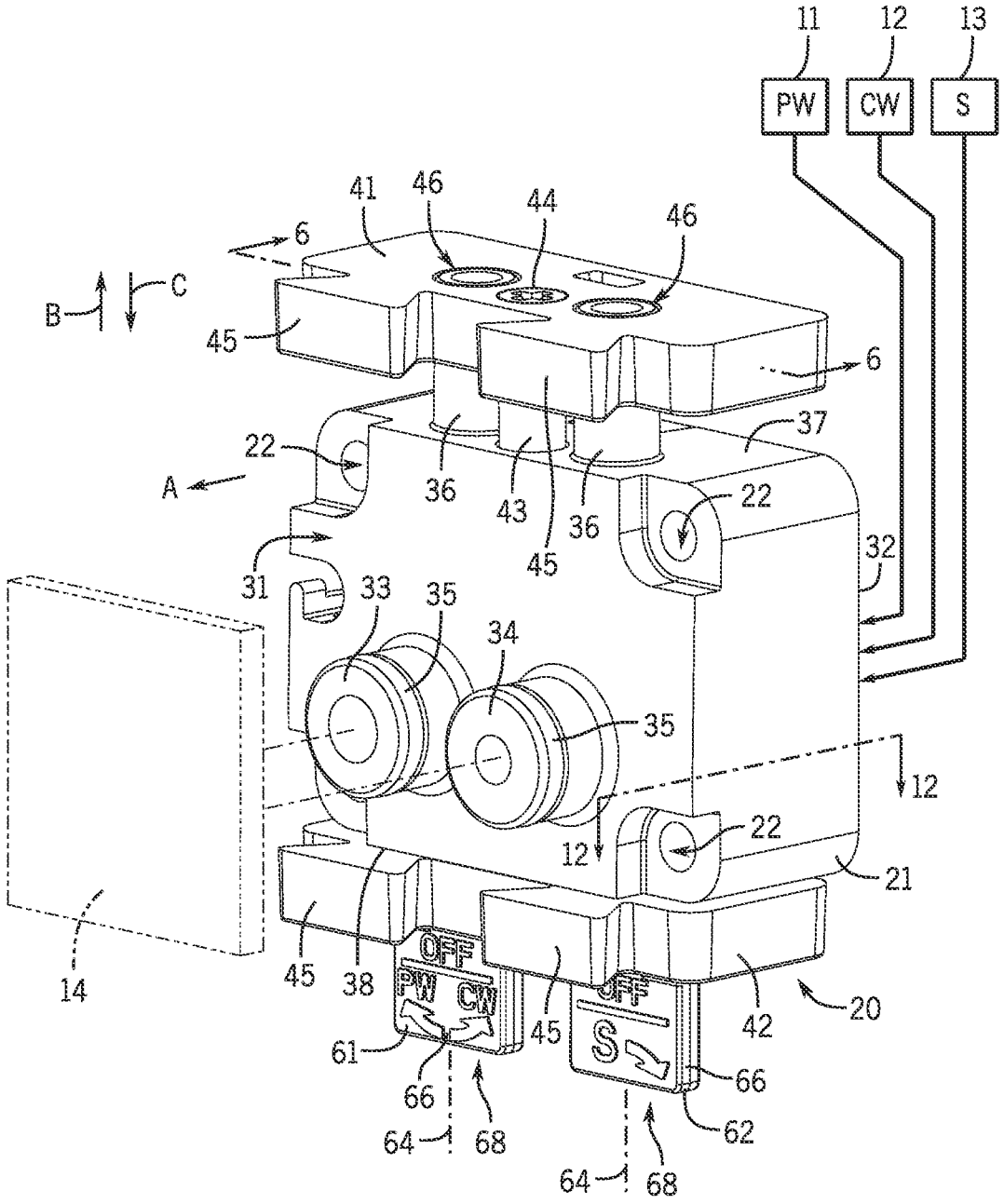
FIG. 2 is a front perspective view of a backblock of the present disclosure.
Figure 3:
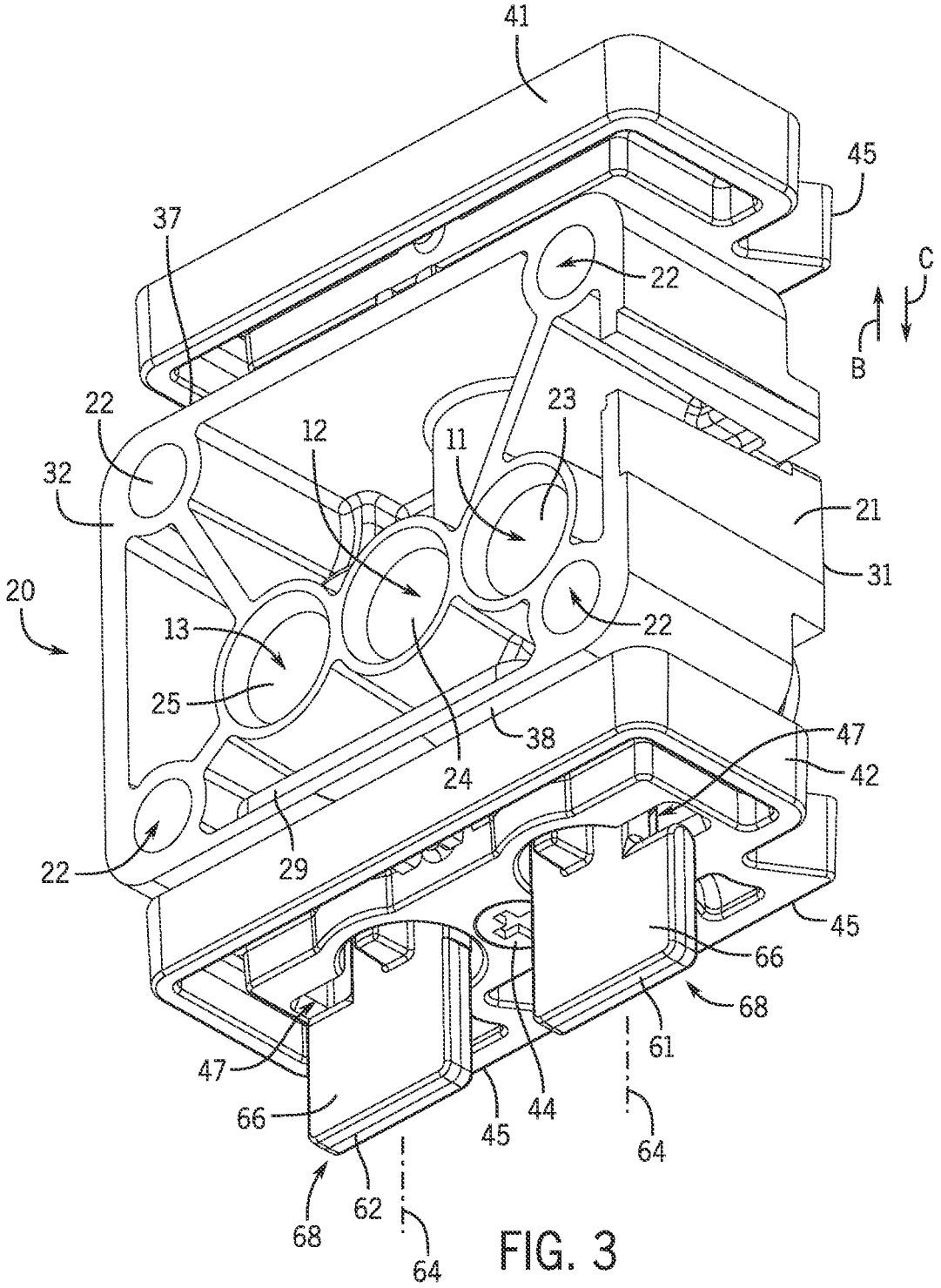
FIG. 3 is a rear perspective view of the backblock.
Figure 4:
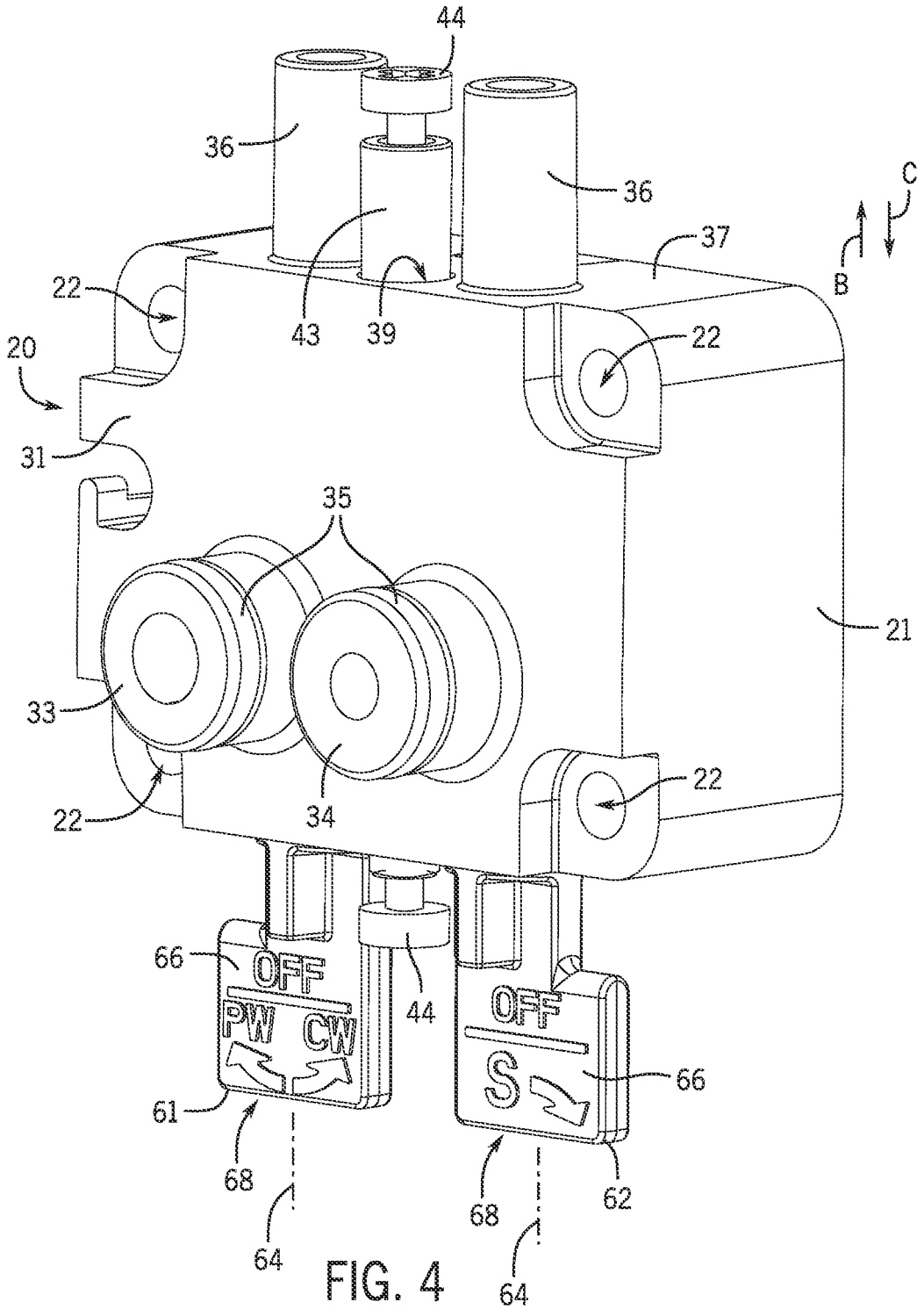
FIG. 4 is a front perspective view of the backblock without latching plates.

FIGS. 2-4 depict a detailed example of the backblock 20. FIG. 2 is a front perspective view of the backblock 20. FIG. 3 is a rear perspective view of the backblock 20. FIG. 4 is a front perspective view of the backblock 20 with the latching plates 41, 42 (described in further detail herein) removed for additional clarity. The backblock 20 receives a plurality of different fluids from the fluid sources, including the plain water source 11, carbonated water source 12, and the one or more concentrated flavor syrup sources 13. The backblock 20 includes a plain water inlet 23 which is configured to fluidly connect to the plain water source 11 to receive the plain water. A carbonated water inlet 24 is configured to fluidly connect to the carbonated water source 12, and the syrup inlet 25 is configured to fluidly connect to a concentrated flavor syrup source of the one or more concentrated flavor syrup sources 13. Such fluid connection may be provided by flexible tubing, rigid tubing, or a combination thereof.

The backblock 20 has a body 21 with a first surface 31 that faces the valve 14 and a second surface 32, opposite the first surface 31, that faces away from the valve 14 for example, toward the frame 18 (FIG. 1). A plurality of bores 22 extend through the body 21 such that fasteners (not depicted; e.g., screws) extend through the bores 22 from the side of the first surface 31 to secure the backblock 20 to the frame 18.

Figure 12:
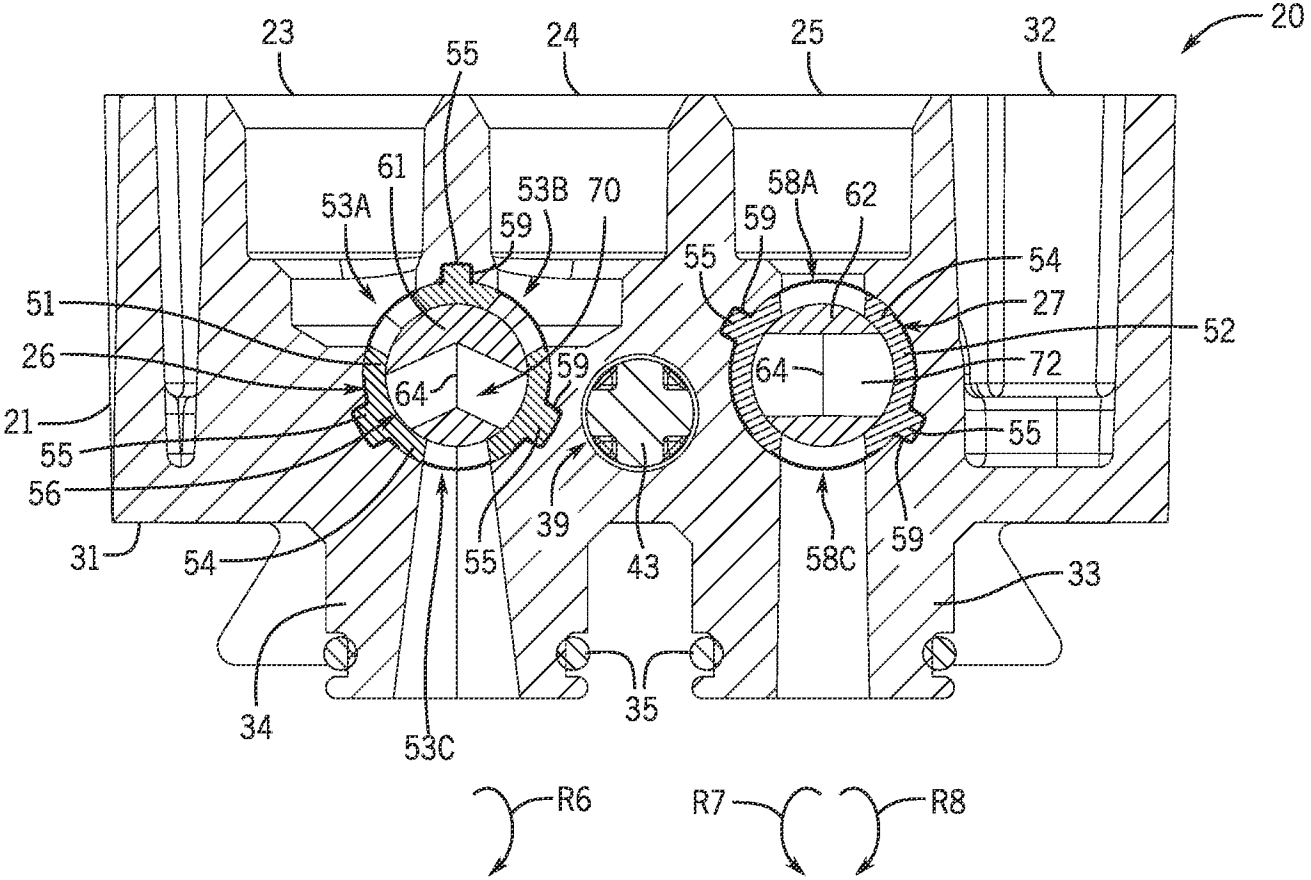
FIG. 12 is a cross-sectional view of the backblock of FIG. 1 along line 12-12 on FIG. 2.
Figure 13:
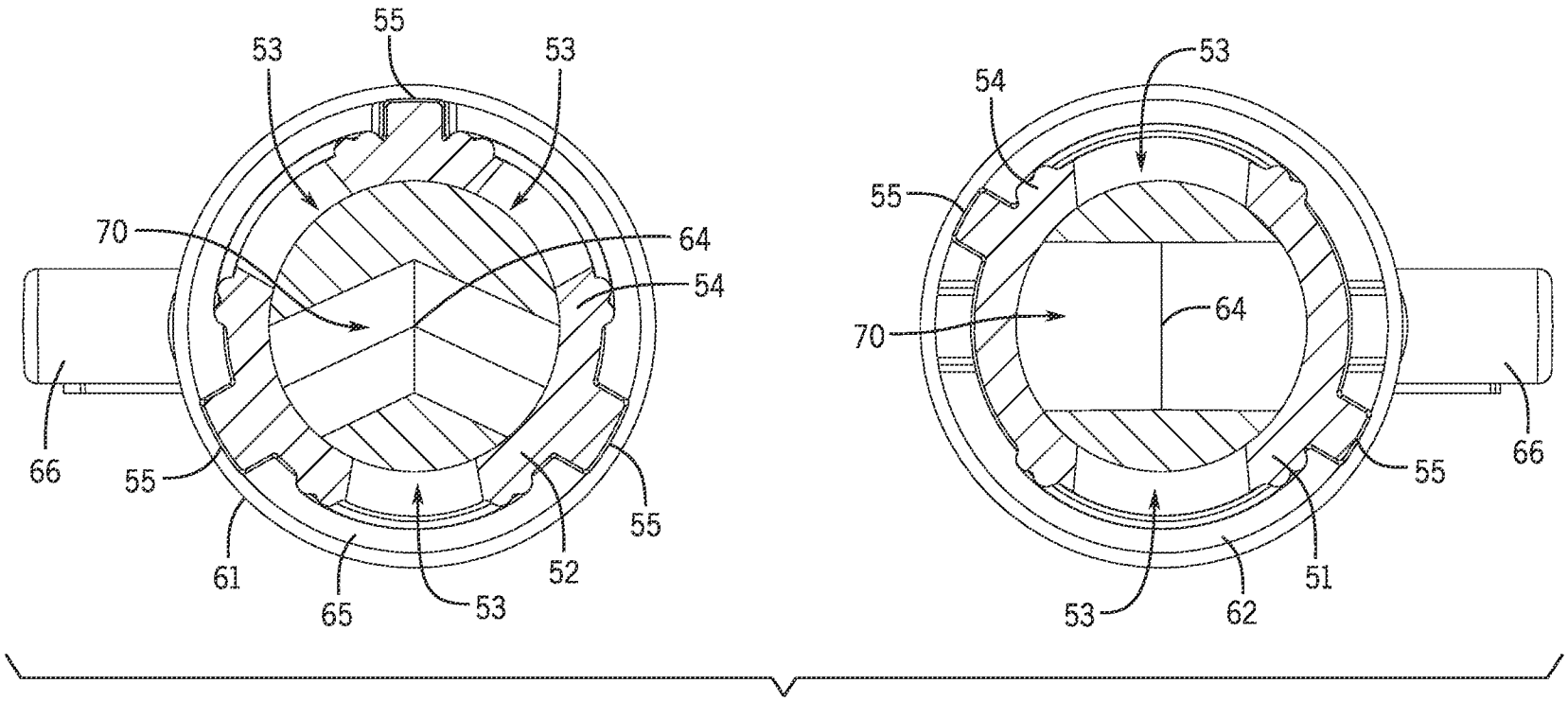
FIG. 13 is a detailed view of the sleeves and spindles of FIG. 12.

FIG. 12 is a cross-sectional view of the backblock 20 taken along line 12-12 of FIG. 2. The plain water inlet 23 and the carbonated water inlet 24 are fluidly connected to a first cavity 26 defined in the body 21, and the syrup inlet 25 is fluidly connected to a second cavity 27 defined in the body 21. A water sleeve 51 and a syrup sleeve 52 are depicted with hatched shading and the first ends 67 of the spindles 61, 62 are depicted with cross-hatched shading for clarity. O-rings 69 on the spindles 61, 62 create a fluid-tight seal between the respective spindles 61, 62 and sleeves 51, 52. A clip 29 (denoted as shaded squares on FIG. 6, see also FIG. 5) secures the spindles 61, 62 to the body 21 and prevents axial movement of the sleeves 51, 52 within the cavities 26, 27. The sleeves 51, 52 include ribs 55 which fit into channels 59, the engagement of which secures the sleeves 51, 52 against rotation within the cavities 26, 27. FIG. 13 the same view as FIG. 12 with detailed isolation of the spindles 61, 62 and sleeves 51, 52.

The water sleeve 51 is positioned within the first cavity 26. The water sleeve 51 includes three openings through a sidewall 54 into an open interior 56 of the water sleeve 51. When the water sleeve 51 is in the first cavity 26, a plain water opening 53A is open to the plain water inlet 23, a carbonated water opening 53B is open to the carbonated water inlet 24, and a diluent outlet 53C is open to the diluent outlet 33. The syrup sleeve 52 is positioned within the second cavity 27. The syrup sleeve 52 includes two openings through a sidewall 54 into an open interior 57 of the syrup sleeve 52. An inlet opening 58A is open to the syrup inlet 25 and an outlet opening 58B is open to the syrup outlet 34. A water control spindle 61 is rotatably positioned within the water sleeve 51 and a syrup control spindle 62 is rotatably positioned within the syrup sleeve 52.

Figure 6:
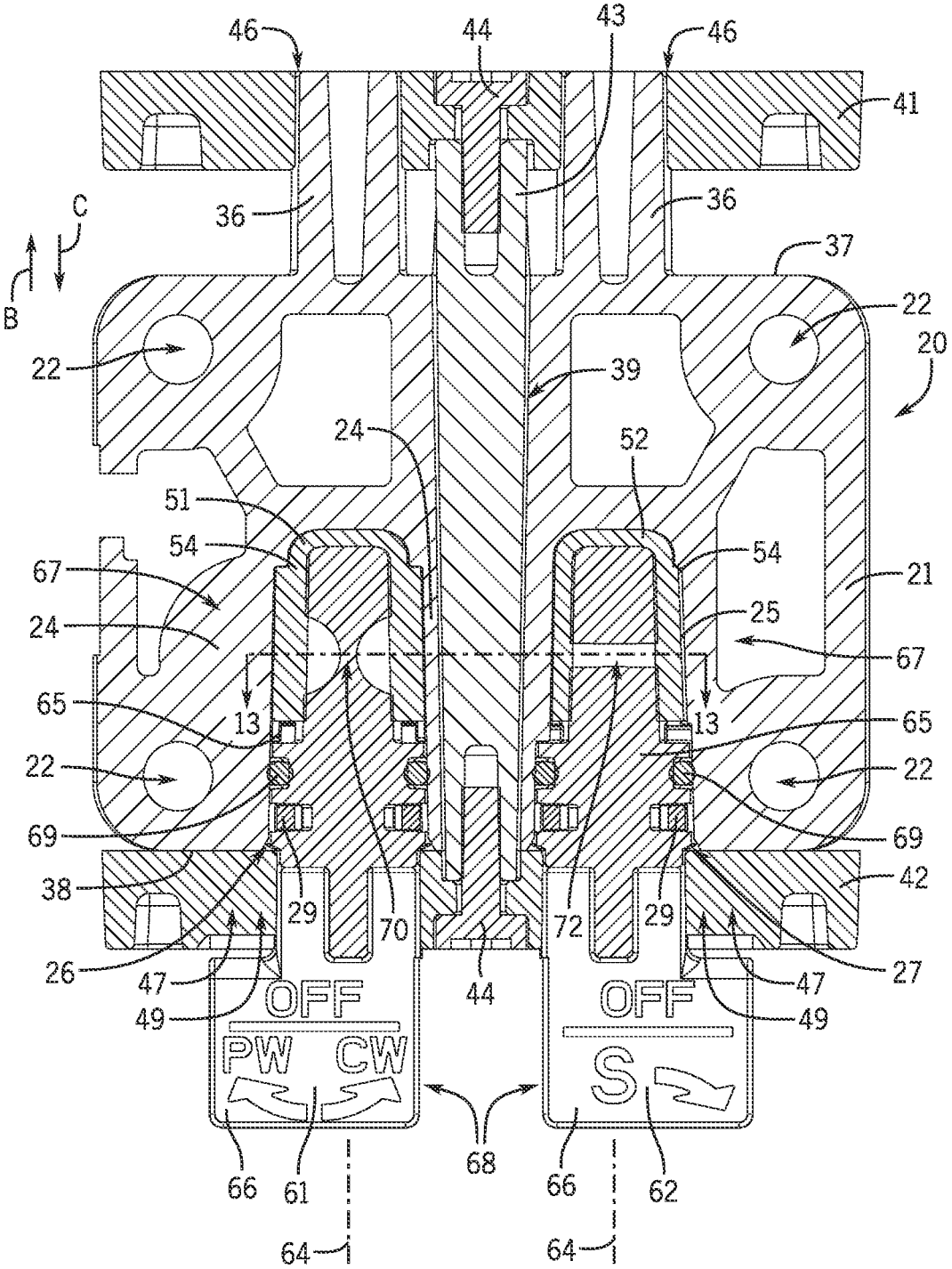
FIG. 6 is a cross-sectional view of the backblock of FIG. 1 along line 6-6 on FIG. 2.

Rotation of the water control spindle 61 within the water sleeve 51 and rotation of the syrup control spindle 62 within the syrup sleeve 52 respectively control a flow of fluids through the backblock 20. Each spindle 61, 62 has a main body 65 that extends along an axis 64 from a first end 67 to a second end 68. The first end 67 is configured to be received within the body 21 of the backblock 20 and the second end 68 is configured to extend outside of the body 21. A tab 66 is located at the second end 68 and extends radially outward from the axis 64. Each spindle 61, 62 is rotatable about its own axis 64 into and between different positions to control the flow of fluids through the backblock 20. The tab 66 provides exemplarily provides a feature to which an operator can apply a rotative force against the respective spindle 61, 62 to move the spindle 61, 62 into positions as described herein. As best seen in FIGS. 6 and 12, a water passage 70 extends through the water spindle 61 and a syrup passage 72 extends through the syrup spindle 62. The syrup passage 72 is exemplarily a straight passage configured to fluidly connect the syrup inlet 25 to the syrup outlet 34 when the syrup spindle 62 is rotated to an open position the syrup passage 72 into alignment therewith. The syrup spindle 62 is in a closed position when the syrup passage 72 occludes a flow of syrup from the syrup inlet 25 to the syrup outlet 34, as shown. The water passage 70 is exemplarily bent or angled to provide at least three operative positions. A first operative position, as shown in FIG. 12, is a closed position wherein the water passage 70 does not fluidly connect to either of plain water inlet 23 or the carbonated water inlet 24. Rotation of the water spindle 61 in the direction or either arrow R7 or R8 positions the water spindle 61 in open position(s) with the water passage 70 respectively providing a fluid connection between either the plain water inlet 23 or the carbonated water inlet 24 to the diluent outlet 33.

Figure 9:
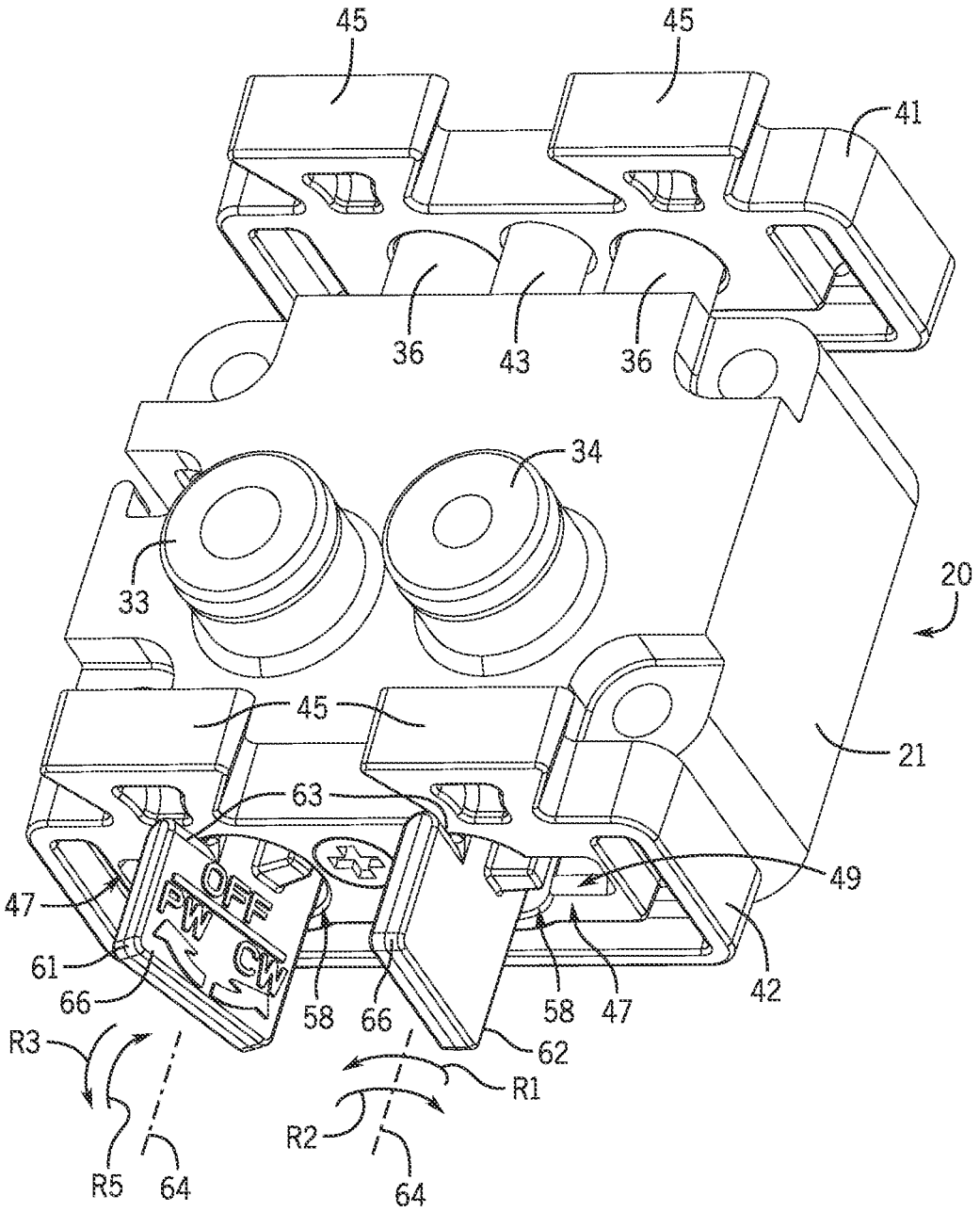
FIGS. 9-10 are perspective views of the backblock with spindles in different open positions.
Figure 10:
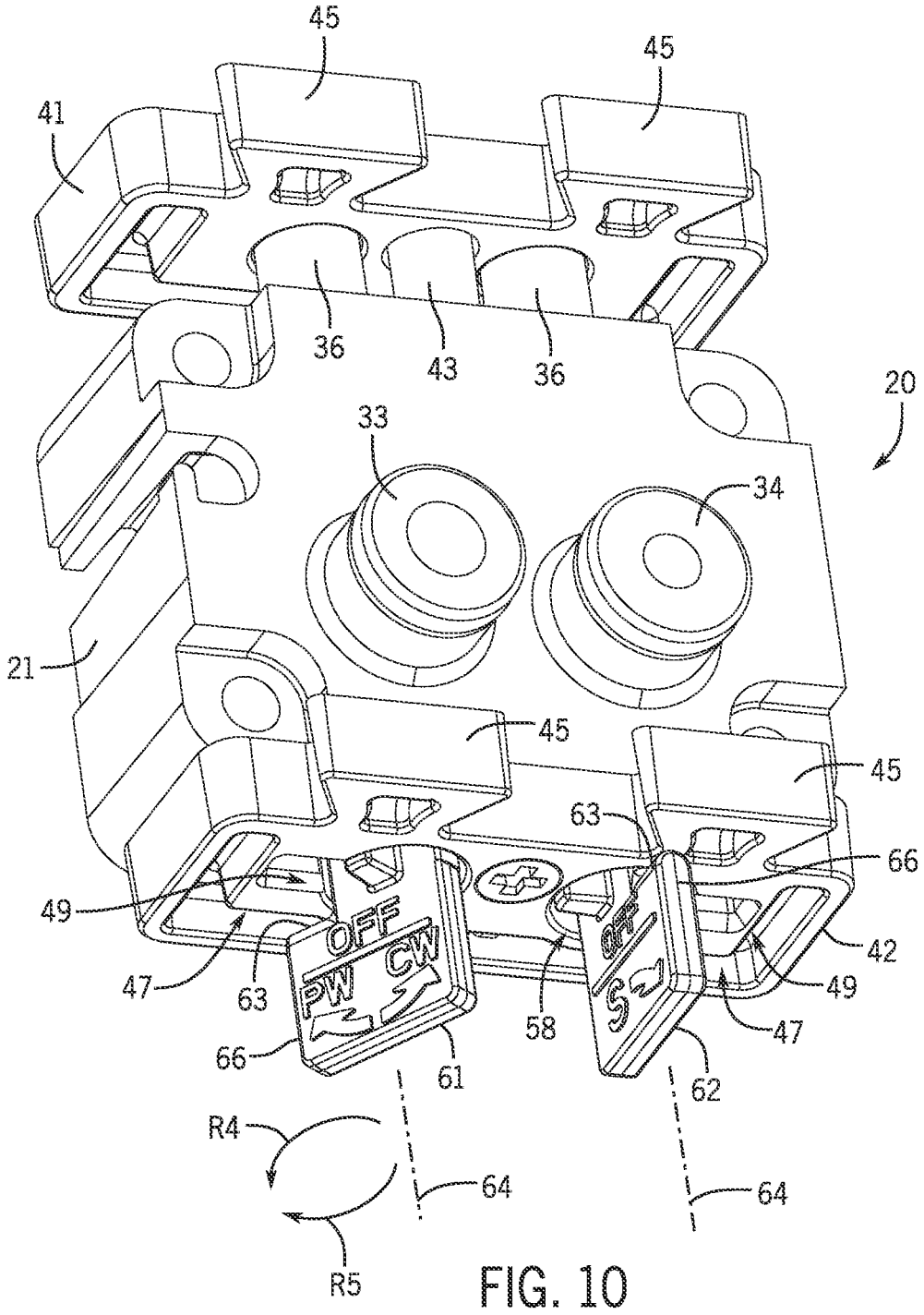

FIGS. 9-10 depict the water spindle 61 in two different open positions, while FIGS. 9 and 10 depict the syrup spindle 62 in the same open position. These positions are contrasted with the closed positions depicted in FIGS. 6, 11, and 12. The syrup spindle 62 is rotated 90 degrees about the axis 64 in a first direction (see arrow R1) relative to the closed position previously described. However, it will be recognized that other degrees of rotation, including but not limited to 15 degrees, 30 degrees, 45 degrees, and 60 degrees may exemplarily be used between the open and closed positions.

FIG. 9 depicts in the water spindle 61 in a first open position in which the water spindle 61 fluidly connects the plain water inlet 23 to the diluent outlet 33 through the backblock 20. Rotation of the water spindle 61 exemplarily 65 degrees about the axis 64 in the direction represented by arrow R3 relative to the closed position of the water spindle 61 moves the water spindle 61 into this first open position. Rotation of the water spindle 61 exemplarily 65 degrees about the axis 64 in the direction represented by arrow R4 relative to the closed position of the water spindle 61 moves the water spindle into a second open position. In the second open position, the water spindle 61 fluidly connects the carbonated water inlet 24 to the diluent outlet 33 through the backblock 20. It will be recognized that other angles of rotation may be used, including but not limited to angles of rotation between 45 degrees and 85 degrees or between 60 and 70 degrees.

Figure 8:
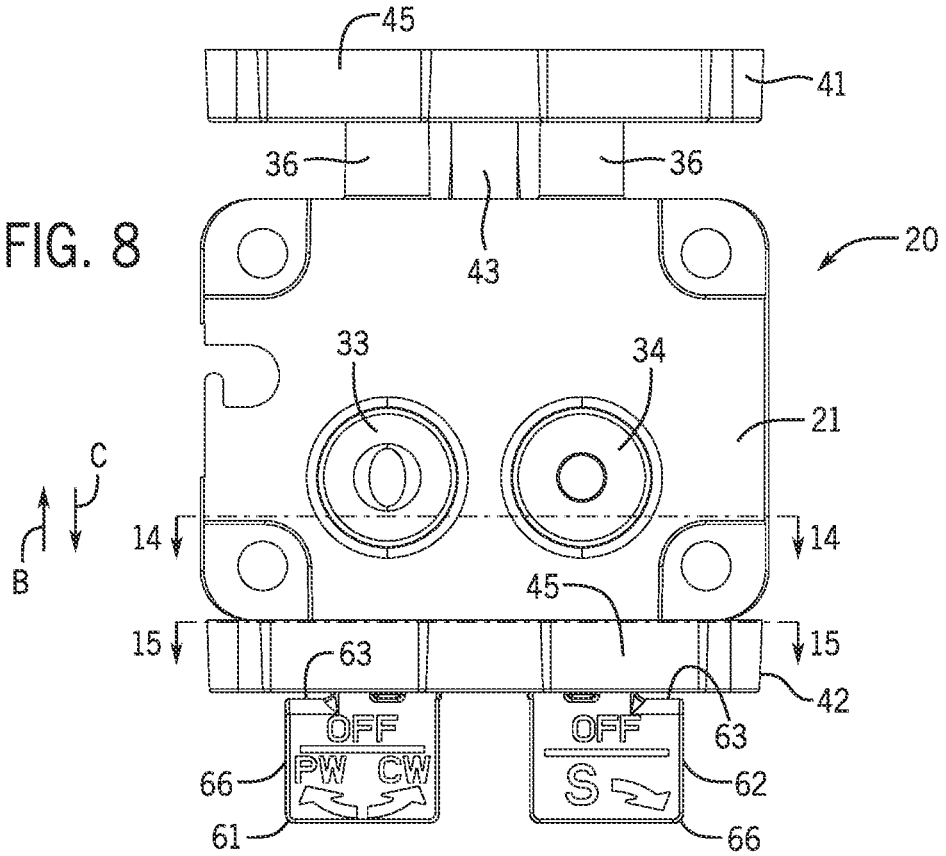
FIG. 8 is a front view of the backblock in a latched configuration.
Figure 14:
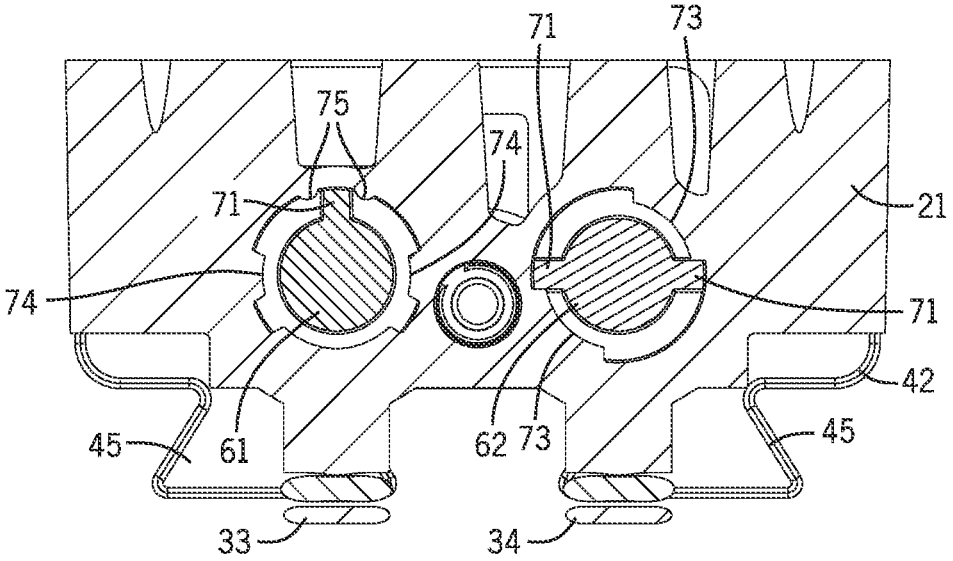
FIG. 14 is a cross-sectional view taken along line 14-14 of FIG. 8.

FIG. 14 is a sectional view of the backblock 20 taken along line 14-14 of FIG. 8. In this view, the spindle stops 71 on both of the spindles 61, 62 are better seen. The syrup 62 spindle 62 includes two spindle stops 71, located radially opposite one another. In the closed position, the spindle stops 71 each engage one of two stop projections 73 of the body 21. Rotation of the syrup spindle 90 degrees to the open position, engages the two stop projections 73 with the other of the two spindle stops 71. Thus in both of the terminal positions of the rotation of the syrup spindle 62, the spindle stops 71 are in engagement with a respective stop projection 73. The stopping force to resist further rotation of the spindle in either direction is divided between the two spindle stops 71.

The water spindle 61 is arranged in a manner different from that of the syrup spindle 62 owning to the difference in the operation of the spindles 61, 62 and the rotational angles between the terminal positions of the water spindle 61. The water spindle 61 includes a single spindle stop 71, which rotates an exemplary 65 degrees in a first direction to a terminal position in which the plain water is open and rotates an exemplary 65 degrees in a second direction to a terminal position in which the carbonated water is open. Two respective stop projections 74 of the body 21 define each of the terminal positions and the spindle stop 71 engages one of the stop projections 74 when the spindle 61 is in one of the terminal positions. The closed position of the spindle 61 is further defined by two ribs 75 of the body 21 and which resist or interfere with movement of the spindle stop 71, but do not obstruct movement of the spindle stop to resistively define the stop position of the spindle 61 with the spindle stop 71 between the ribs 75.

Figure 15:
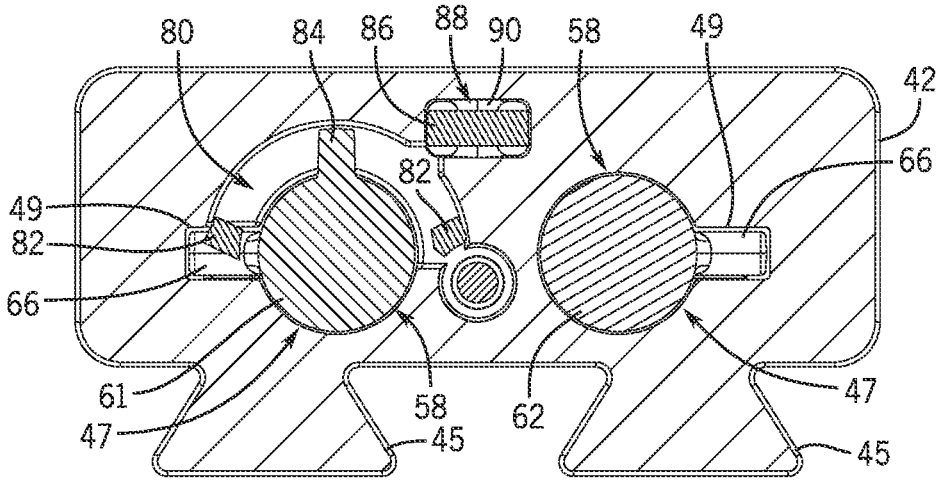
FIG. 15 is a cross-sectional view taken along line 15-15 of FIG. 8.
Figure 16:
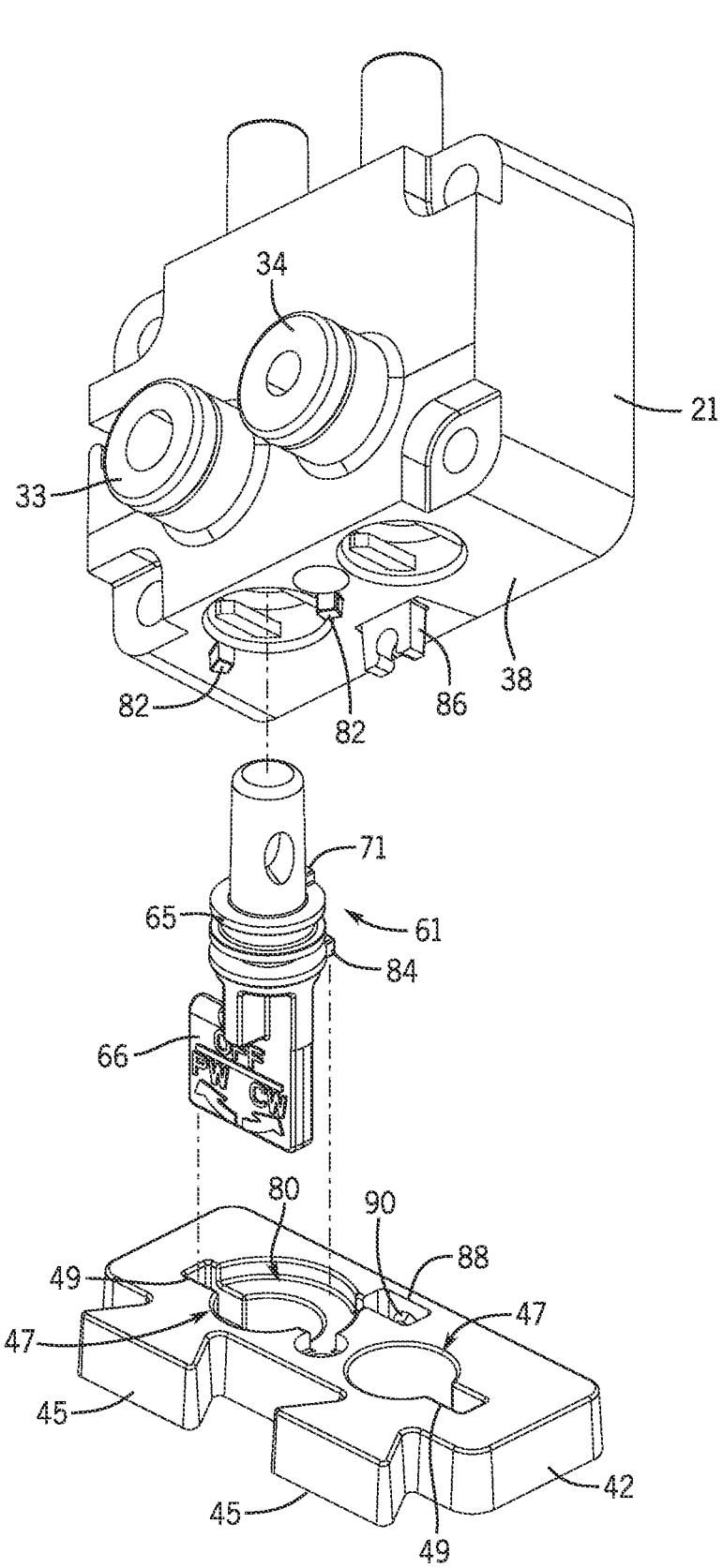
FIG. 16 is further partial exploded view of the backblock.

FIG. 15 is a sectional view of the backblock 20 taken along line 15-15 of FIG. 8. FIG. 16 is an exploded view of the detailing features as discussed herein. Latching plate 42 includes a groove 80 that extends approximately 180 degrees about the bore 58 of the keyhole 47 around the water spindle 61. Stops 82 project outwardly from the fourth surface 38 of the body 21 on either side of the cavity 26. The stops 82 are received within the groove 80 when the latching plate 42 is in position against the fourth surface 38. The water spindle 61 further includes stop tab 84 that projects radially outward from the body 65 of the water spindle 61. When the latching plate 42 is in position against the fourth surface 38, the stop tab 84 is also received within the groove 80.

The stop tab 84 of the water spindle 61 is in radial alignment with the spindle stop 71 of the water spindle 61 described above. Similarly, the stops 82 define the same terminal positions as do the stop projections 74. An interior angle between the stops 82 matches an interior angle between the stop projections 74. Therefore, both terminal open positions of the water spindle 61 are defined by engagement between the spindle stop 71 and one of the stop projections 74 as well as engagement between the stop tab 84 and one of the stops 82. This distributes the stopping force to resist further rotation of the water spindle 61 in either direction beyond the terminal open positions between both the stop tab 84 and the spindle stop 71, and their respective engagement with a stop 82 and stop projection 74.

The diluent outlet 33 is fluidly connected to the first cavity 26 and extends away from the first cavity 26 in a direction opposite from the plain water inlet 23 and the carbonated water inlet 24. The syrup outlet 34 is fluidly connected to the second cavity 27 and extends away from the second cavity 27 in a direction opposite from the syrup inlet 25. The outlets 33, 34 further project proud of the first surface 31 (see direction denoted by arrow A) of the body 21. When the valve 14 is coupled to the backblock 20, the outlets 33, 34 are received into corresponding inlets (not depicted) of the valve 14 to physically and fluidly connect the valve 14 to the backblock 20. Fluids permitted to pass through the backblock 20 as described herein flow through the outlets 33, 34 into the valve 14. O-rings 35 surrounding each outlet 33, 34 are compressed upon connection of valve 14 to the backblock 20 to increase a friction connection and to create fluid-tight seals therebetween.

Figure 5:
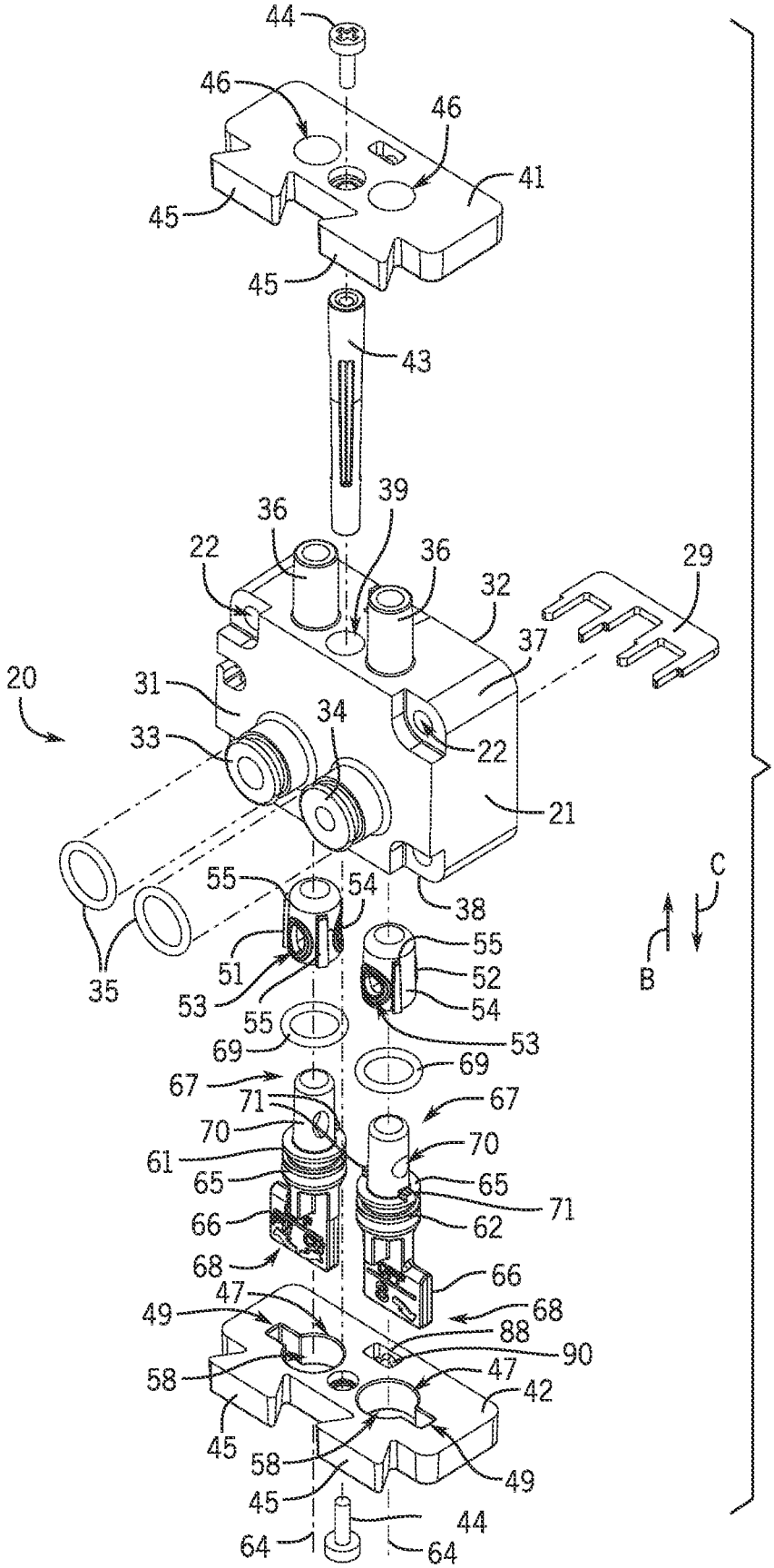
FIG. 5 is an exploded view of the backblock.

Referring back to FIGS. 2-4, the body 21 of the backblock 20 further includes a third surface 37 and a fourth surface 38 opposite the third surface 37. The first cavity 26 and the second cavity 27 open to the fourth surface 38. The third surface 37 is opposite the fourth surface 38. The third surface 37 and the fourth surface 38 is generally orthogonal to the first surface 31 and the second surface 32 and extend therebetween. FIG. 5 is an exploded view of the backblock 20. FIG. 6 is a cross-sectional view of the backblock 20 taken along line 6-6 of FIG. 2. A bore 39 extends through the body 21 of the backblock 20 between the third surface 37 and the fourth surface 38. A pair of cylindrically shaped studs 36 extend in a direction away from the third surface 37 (see direction denoted by arrow B).

Figure 7:
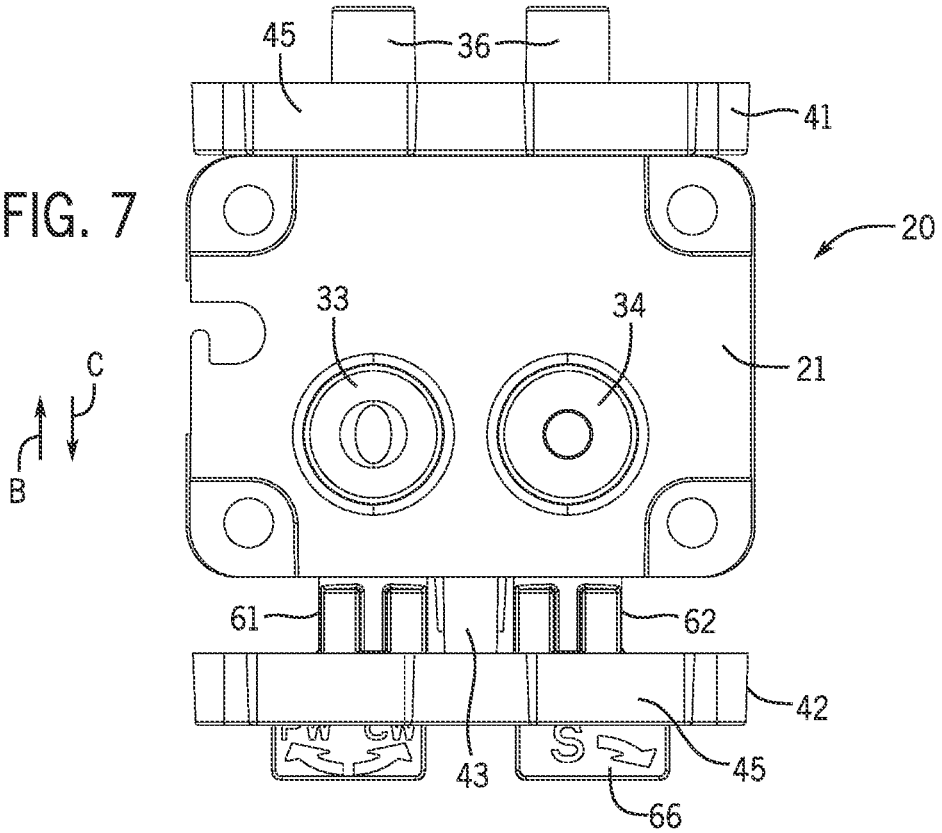
FIG. 7 is a front view of the backblock in an unlatched configuration.

The backblock 20 further includes first latching plate 41 and second latching plate 42 which function to connect the backblock 20 to the valve. The first latching plate is adjacent to the third surface 37 and the second latching plate 42 is adjacent to the fourth surface 38. Although the latching plates 41, 42 are spaced apart from each other and the body 21 is positioned between the latching plates 41, 42, the latching plates 41, 42 are connected via a rod 43 that extends through the bore 39 in the body 21. Specifically, each end of the rod 43 is connected to one of the latching plates 41, 42. Thus, the rod 43 and the latching plates 41, 42 form a latching assembly 48 that is movable relative to the body 21. Specifically, the latching assembly 48 moves relative to the body 21 between an unlatched configuration of the backblock 20 (FIG. 7) in which latching plates are in a position such that the valve 14 can be coupled to or decoupled from the backblock 20 and a latched configuration of the backblock 20 (FIGS. 1 and 8) in which the latching plates 41, 42 are in a position engage the valve 14 to thereby secure the valve 14 to the backblock 20. In the example depicted, screws 44 secure each of the latching plates 41, 42 to a respective end of the rod 43, while it is recognized that other manners of securement including welding, fasteners, or adhesive may be used. In an example, engagement arms 86 extend away from the fourth surface 38 of the body 21. When the latching assembly 48 is in the latched configuration with the latching plate 42 in contact with the fourth surface 38, the engagement arms 86 are received within a recess 88 in the latching plate 42. The engagement arms 86 resiliently secure to an engagement rod 90 therein to form a positive connection indicating that the latching assembly is in the latched position. The engagement arms 86 and engagement rod 90 further offer resistance to move the latching assembly into the unlatched position to resist unintentional or inadvertent unlatching of the backblock 20.

Each latching plate 41, 42 has at least one, or as depicted two, engagement features 45 which are configured to releasably connect to the valve 14. In the example depicted, the engagement features 45 extend as trapezoidal projections away from the latching plates 41, 42 in the direction of the valve 14 (see direction denoted by arrow A). However it will be recognized that the engagement features may take other numbers, forms, or shapes while remaining within the scope of the present disclosure. In further examples, the engagement features may include recesses (e.g. voids, cutouts) configured to receive a projection extending from the valve. In use, after the operator couples the valve 14 to the outlets 33, 34 as described above, the operator moves the latching plates 41, 42 in a first direction (see direction denoted by arrow B) from an unlatched position (FIG. 7) to the latched position (FIGS. 1 and 8). Such movement causes the engagement features 45 of the latching plates 41, 42 to translate relative to the valve 14, to position engagement features 45 into contact with recesses (not depicted) in the valve 14 configured to retain the engagement features 45. The shape of the recesses corresponds to the shape of the engagement features 45 such that the engagement features 45 are retained within the recesses. Accordingly, interference engagement by the engagement features 45 prevents the valve 14 from inadvertently decoupling from the backblock 20. In certain examples, the engagement features 45 and the cutouts form a dovetail connection. To unlatch or decouple the valve 14 from the backblock 20, the operator moves the latching plates 41, 42 in a second direction (see the direction denoted by arrow C) opposite the first direction such that the engagement features 45 are moved out of the cutouts. The operator can then move the valve away from the backblock 20 (e.g., pull the valve 14 in a direction away from the backblock 20).

As previously noted, studs 36 extend away from the third surface 37 of the body 21 of the backblock 20. While the studs 36 are depicted as cylindrical, it is recognized that the studs 36 may take other shapes, and may also be tapered such that the fixed end of the stud 36 has a diameter that is larger than the diameter of the free end of the stud 36, or other configurations as will be recognized from the present disclosure. The first latching plate 41 has openings 46 through which the studs 36 are received. As the backblock 20 is operated from the unlatched configuration to the latched configuration, the first latching plate 41 is moved from the unlatched position, in contact with or close proximity to, the third surface 37, to the unlatched position (FIG. 8) away from the third surface 37 by translation along the studs 36 received within the openings 46.

Figure 11:
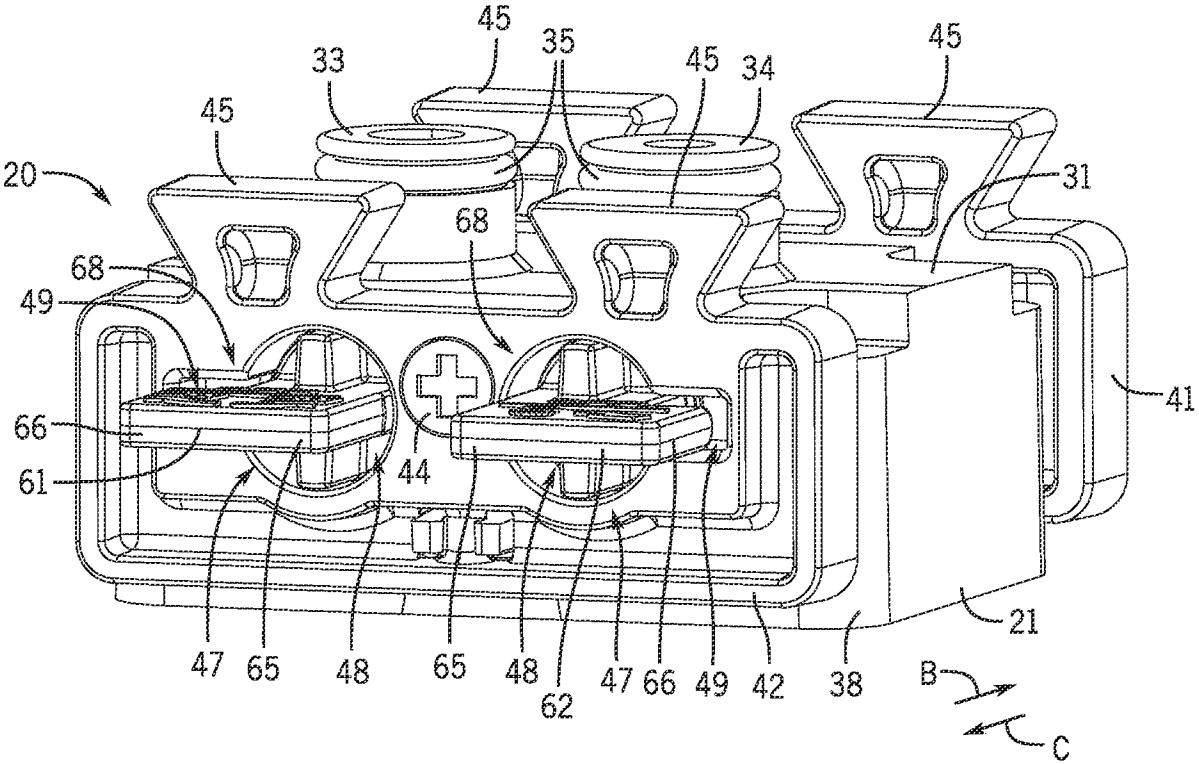
FIG. 11 is an end view of the backblock.

Referring now to FIGS. 5-11, the second latching plate 42 has two keyholes 47 defined therein. The keyholes 47 are shaped to respectively receive the water spindle 61 and the syrup spindle 62 therethrough. More specifically, the keyholes 47 are shaped with a bore 58 configured to receive the body 65 of the spindle and a channel 49 configured to receive the tab 66 of the spindle therethrough when the tab 66 is positioned in alignment with the channel 49 keyhole 47. FIG. 11 is an end view of the backblock 20 with the water spindle 61 and the syrup spindle 62 in the closed positions which also aligns the respective tabs 66 of those spindles with a respective keyhole 47 through the second latching plate 42. This is contrasted with FIGS. 9 and 10 in which the water spindle 61 and the syrup spindle 62 are in exemplary open positions, and the tab 66 of each spindle is not in alignment with the respective keyhole 47 of the second latching plate 42.

The water spindle 61 and the syrup spindle 62 are configured to interact with the second latching plate 42 to limit the operations of the backblock 20. As previously noted, the tabs of the water spindle 61 and the syrup spindle 62 are only in alignment with the channel 49 of the keyholes 47 when the water spindle 61 and the syrup spindle 62 are in the closed positions, occluding any fluid flow through the backblock 20. Thus the second latching plate can only translate over the tabs 66 to move the latching assembly 48 into the unlatched position when both the water spindle 61 and the syrup spindle 62 are in the closed positions. (See FIGS. 7, 8, and 11) When either spindle is in an open position, a tab 66 of that spindle is not in alignment with a respective channel 49 of the keyhole 47. (See FIGS. 9 and 10) Engagement of the second latching plate 42 against a tab surface 63 blocks translation of the second latching plate 42 and the latching assembly 48 from the latched position to the unlatched position. Accordingly, the latching assembly 48 cannot be moved from the latched position to the unlatched position unless fluid flow through the backblock 20 is occluded. Similarly, the fluid flow through the backblock 20 cannot be initiated until the latching assembly 48 is moved into the latched position, whereby the tabs 66 have passed entirely through the channels 49 and are rotatable out of alignment with the channels 49.

To decouple the valve 14 from the backblock 20, an operator must ensure that the water control spindle 61 is in the closed position, occluding the flow of either plain water or carbonated water through the backblock 20 to the diluent outlet 33. The closed position of the water control spindle 61 also aligns the tab 66 with the channel 49. The operator must also ensure that the syrup control spindle 62 is in the closed position, occluding the flow of syrup through the backblock 20 to the syrup outlet 34. The closed position of the syrup control spindle 62 also aligns the tab 66 with the channel 49. With the water control spindle 61 and the syrup control spindle 62 in the closed positions and the respective tabs 66 extending therefrom in alignment with the channels 49 of the keyholes 47, the latching assembly 48 can be moved to from the latched position to the unlatched position and the second latching plate 42 of the latching assembly 48 translated around the tabs 66.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives, and modifications are possible within the scope of the appended claims.

This written description uses examples to disclose the invention, including the best mode, and also to enable any person skilled in the art to make and use the invention. The patentable scope of the invention is defined by the claims and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A backblock for use in beverage dispensing, comprising:

a body having:

an inlet configured to receive a fluid;

an outlet configured to dispense the fluid; and a cavity defined within the body, the cavity open to the inlet and to the outlet;

a spindle elongated in an axial dimension between a first end and a second end, the spindle positioned with the first end within the cavity and the second end exterior of the body to permit rotation of the spindle about the axial dimension within the cavity;

a tab at the second end of the spindle; and a latching plate configured for translative movement relative to the body, the latching plate comprising a keyhole with a bore and a channel wherein the bore is dimensioned to receive the spindle and the channel is dimensioned to receive the tab, the latching plate having a first latch position proximate to the body and a second latch position spaced apart from the body, wherein when the tab is in alignment with the channel, the latching plate can translate to the second latch position about the tab and when the tab is out of alignment with the channel, the tab retains the latching plate in the first latch position.

2. The backblock of claim 1, wherein the spindle comprises a passageway therethrough, the passageway configured to fluidly connect the inlet to the outlet.

3. The backblock of claim 2, wherein the spindle is rotatable about the axial dimension within the cavity between a first spindle position wherein the passageway is oriented within the cavity to occlude fluid flow from the inlet to the outlet and a second spindle position wherein the passageway is in alignment with the inlet and the outlet to permit fluid flow from the inlet to the outlet, and wherein in the first spindle position, the tab is in alignment with the channel and in the second spindle position the tab is out of alignment with the channel.

4. The backblock of claim 3, wherein the inlet is a plain water inlet to receive plain water, and the body further comprises a carbonated water inlet open to the cavity and configured to receive carbonated water.

5. The backblock of claim 4, wherein the spindle is rotatable to a third spindle position within the cavity wherein the passageway is in alignment between with the carbonated water inlet and the outlet to permit carbonated water flow from the carbonated water inlet to the outlet through the passageway, and wherein in the third spindle position the tab is out of alignment with the channel.

6. The backblock of claim 5, wherein the spindle comprises a first spindle stop on a portion of the spindle received within the cavity and the spindle comprises a stop tab on a portion of the spindle exterior of the body, wherein the first spindle stop and the stop tab respectively engage portions of the body to define rotation of the spindle to the second spindle position and the third spindle position.

7. The backblock of claim 6, wherein the body comprises a first side comprising the outlet and a second side comprising the plain water inlet and the carbonated water inlet are located in the second and the body comprises a third side and a fourth side opposite the third side; wherein the third side and the fourth side extend orthogonally between the first side and the second side, the backblock further comprising:

a latching assembly that comprises a pair of latching plates, comprising the latching plate and a rod extending between the pair of latching plates, such that the latching assembly translates as a unit between the first latch position and the second latch position;

wherein the body comprises a bore through the body extending from the third side to the fourth side and the rod extends through the bore between the pair of latching plates.

8. A backblock for use in beverage dispensing, comprising:

a body having:

a first side, a second side opposite the first side, a third side, and a fourth side opposite the third side, wherein the third side and the fourth side extend between the first side and the second side;

a first inlet through the second side, the first inlet configured to receive a first fluid;

a second inlet through the second side, the second inlet configured to receive a second fluid;

a third inlet through the second side, the third inlet configured to receive a third fluid;

a first outlet from the first side, the first outlet fluidly connected to the first inlet and a second inlet through a first cavity in the body;

a second outlet from the first side, the second outlet fluidly connected to the third inlet through a second cavity in the body;

a first spindle rotatably positioned within the first cavity and a second spindle rotatably positioned within the second cavity, each of the first spindle and the second spindle elongated in an axial dimension between a first end positioned within the respective cavity and a second end extending exterior of the body;

a first tab at the second end of the first spindle;

a second tab at the second end of the second spindle; and a latching assembly configured for unitary translative movement relative to the body between a first latch position with the first latch plate spaced apart from the third side of the body and the second latch plate proximate to the fourth side of the body and a second latch position with the first latch plate proximate the third side of the body and the second latch plate spaced apart from the fourth side of the body, the latching assembly comprising:

a first latching plate adjacent to the third side of the body; and a second a latching plate adjacent to the fourth side of the body and comprising:

a first keyhole with a first bore and a first channel wherein the first bore is dimensioned to receive the first spindle and the first channel is dimensioned to receive the first tab; and a second keyhole with a second bore and a second channel wherein the second bore is dimensioned to receive the second spindle and the second channel is dimensioned to receive the second tab;

wherein when the first tab is out of alignment with the first channel or the second tab is out of alignment with the second channel, the first tab or the second tab retain the latching assembly in the first position, and wherein when the first tab is in alignment with the first channel and the second tab is in alignment with the second channel, the latching assembly can translate between the first position and the second position.

9. The backblock of claim 8, wherein the first tab extends radially away from the axial dimension of the first spindle and the second tab extends radially away from the axial dimension of the second spindle.

10. The backblock of claim 9, wherein the first spindle comprises a first passageway therethrough, the first passageway configured to selectively connect the first inlet or the second inlet to the first outlet.

11. The backblock of claim 10, wherein the first spindle is rotatable about the axial dimension within the first cavity between a first spindle position wherein the first passageway is oriented within the first cavity to occlude fluid flow from the first inlet or the second inlet to the first outlet, a second spindle position wherein the first passageway is in alignment with the first inlet and the first outlet to permit flow of the first fluid from the first inlet to the first outlet through the first passageway, and a third spindle position wherein the first passageway is in alignment with the second inlet and the first outlet to permit flow of the second fluid from the second inlet to the first outlet through the first passageway.

12. The backblock of claim 11, wherein in the first spindle position, the first tab is in alignment with the first channel and in the second spindle position or the third spindle position the first tab is out of alignment with the first channel.

13. The backblock of claim 12, wherein the second spindle comprises a second passageway therethrough, the second passageway configured to selectively connect the third inlet to the second outlet.

14. The backblock of claim 13, wherein the second spindle is rotatable about the axial dimension within the second cavity between a fourth spindle position wherein the second passageway is oriented within the second cavity to occlude fluid flow from the third inlet to the second outlet, and a fifth spindle position wherein the second passageway is in alignment with the third inlet and the second outlet to permit flow of the third fluid from the third inlet to the second outlet through the second passageway, wherein in the fourth spindle position the second tab is in alignment with the second channel and in the fifth spindle position the second tab is out of alignment with the second channel.

15. The backblock of claim 8, wherein the first inlet is a plain water inlet and the first fluid is plain water, the second inlet is a carbonated water inlet and the second fluid is carbonated water, the third inlet is a syrup inlet and the third fluid is a beverage syrup.

16. The backblock of claim 8, wherein the first outlet and the second outlet are both configured for releasable connection to a valve configured to dispense one or more of the first fluid, second fluid, and the third fluid and the first latching plate and the second latching plate each comprise at least one engagement feature configured to releasably secure the backblock to the valve; and wherein the latch assembly is configured to secure to the valve when the latch assembly is in the second latch position and the latch assembly is configured to engage or disengage from the valve when the latch assembly is in the first latch position.

17. The backblock of claim 8, wherein the body further comprises a bore through the body extending from the third side of the body to the second side of the body and the latching assembly comprises a rod extending through the bore, the rod connecting the first latching plate to the second latching plate.

18. The backblock of claim 8, further comprising:

a first sleeve positioned within the first cavity wherein the first spindle rotates within the first sleeve; and a second sleeve positioned within the second cavity wherein the second spindle rotates within the second sleeve.

19. The backblock of claim 8, further comprising:

at least one stud extending from the third surface in a direction away from the third surface; and at least one opening through the first latching plate, the at least one opening configured to receive the at least one stud therein as the latching assembly translates between the first latch position and the second latch position.

20. A beverage dispensing system comprising:

a valve configured to receive a diluent and a syrup, and to dispense a mixed beverage comprising the diluent and the syrup through a nozzle;

a frame configured to provide structural support; and a backblock connected to the frame, the backblock comprising:

a body with a first side, a second side opposite the first side, a third side, and a fourth side opposite the third side, wherein the third side and the fourth side extend between the first side and the second side, a plain water inlet through the second side and configured to receive plain water, a carbonated water inlet through the second side and configured to receive carbonated water, a syrup inlet through the second side and configured to receive syrup, a diluent outlet from the first side, the diluent outlet fluidly connected to the plain water inlet and the carbonated water inlet through a water cavity in the body and to dispense plain water or carbonated water therefrom as the diluent, and a syrup outlet from the first side, the syrup outlet fluidly connected to the syrup inlet through a syrup cavity in the body;

a water spindle rotatably positioned within the water cavity and a syrup spindle rotatably positioned within the syrup cavity, each of the water spindle and the syrup spindle elongated in an axial dimension between a first end positioned within the respective cavity and a second end extending exterior of the body;

a first tab at the second end of the water spindle;

a second tab at the second end of the syrup spindle; and a latching assembly configured for unitary translative movement relative to the body between a first latch position with the first latch plate spaced apart from the third side of the body and the second latch plate proximate to the fourth side of the body and a second latch position with the first latch plate proximate the third side of the body and the second latch plate spaced apart from the fourth side of the body, the latching assembly comprising:

a first latching plate adjacent to the third side of the body; and a second a latching plate adjacent to the fourth side of the body and comprising:

a first keyhole with a first bore and a first channel wherein the first bore is dimensioned to receive the first spindle and the first channel is dimensioned to receive the first tab; and a second keyhole with a second bore and a second channel wherein the second bore is dimensioned to receive the second spindle and the second channel is dimensioned to receive the second tab;

wherein when the first tab is out of alignment with the first channel or the second tab is out of alignment with the second channel, the first tab or the second tab retains the latching assembly in the first position, and wherein when the first tab is in alignment with the first channel and the second tab is in alignment with the second channel, the latching assembly can translate between the first position and the second position.

* * * * *